US010023822B2

(12) United States Patent
Kim et al.

(10) Patent No.: US 10,023,822 B2
(45) Date of Patent: Jul. 17, 2018

(54) PRODUCTION OF BASE OILS FROM PETROLATUM

(71) Applicant: ExxonMobil Research and Engineering Company, Annandale, NJ (US)

(72) Inventors: Jeenok T. Kim, Fairfax, VA (US); Gary P. Schleicher, Milford, NJ (US); Halou Oumar-Mahamat, Belle Mead, NJ (US); Chad H. Mondor, McLean, VA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 164 days.

(21) Appl. No.: 15/019,225

(22) Filed: Feb. 9, 2016

(65) Prior Publication Data

US 2016/0152914 A1 Jun. 2, 2016

Related U.S. Application Data

(63) Continuation of application No. 14/196,050, filed on Mar. 4, 2014, now Pat. No. 9,284,500.

(Continued)

(51) Int. Cl.
*C10M 101/02* (2006.01)
*C10G 69/04* (2006.01)

(Continued)

(52) U.S. Cl.
CPC ..... *C10M 101/02* (2013.01); *C10G 21/003* (2013.01); *C10G 45/02* (2013.01); *C10G 45/06* (2013.01); *C10G 45/08* (2013.01); *C10G 45/58* (2013.01); *C10G 45/62* (2013.01); *C10G 45/64* (2013.01); *C10G 47/00* (2013.01); *C10G 47/04* (2013.01); *C10G 47/16* (2013.01);

(Continued)

(58) Field of Classification Search
CPC ..... C10N 2020/02; C10N 2230/02
USPC ..... 208/19
See application file for complete search history.

(56) References Cited

U.S. PATENT DOCUMENTS 5,110,445 A * 5/1992 Chen ..... C10G 67/0409 208/33
5,288,395 A * 2/1994 Marler ..... C10G 65/12 208/27

(Continued)

*Primary Examiner* — Ellen C McAvoy
(74) *Attorney, Agent, or Firm* — Scott F. Yarnell

(57) ABSTRACT

Methods are provided for producing lubricant base oils from petrolatum. After solvent dewaxing of a brightstock raffinate to form a brightstock base oil, petrolatum is generated as a side product. The petrolatum can be hydroprocessed to form base oils in high yield. The base oils formed from hydroprocessing of petrolatum have an unexpected pour point relationship. For a typical lubricant oil feedstock, the pour point of the base oils generated from the feedstock increases with the viscosity of the base oil. By contrast, lubricant base oils formed from hydroprocessing of petrolatum have a relatively flat pour point relationship, and some of the higher viscosity base oils unexpectedly have lower pour points than lower viscosity base oils generated from the same petrolatum feed. The base oils from petrolatum are also unusual in yielding both high viscosity and high viscosity index and can be generated while maintaining a high yield.

19 Claims, 2 Drawing Sheets

Related U.S. Application Data

(60) Provisional application No. 61/781,785, filed on Mar. 14, 2013.

(51) Int. Cl.

| | |
|---|---|
| ***C10G 65/04*** | (2006.01) |
| ***C10G 67/04*** | (2006.01) |
| ***C10G 69/02*** | (2006.01) |
| ***C10G 73/06*** | (2006.01) |
| ***C10G 73/44*** | (2006.01) |
| ***C10M 101/00*** | (2006.01) |
| ***C10G 45/02*** | (2006.01) |
| ***C10G 45/06*** | (2006.01) |
| ***C10G 45/08*** | (2006.01) |
| ***C10G 45/58*** | (2006.01) |
| ***C10G 45/62*** | (2006.01) |
| ***C10G 45/64*** | (2006.01) |
| ***C10G 47/00*** | (2006.01) |
| ***C10G 47/04*** | (2006.01) |
| ***C10G 47/16*** | (2006.01) |
| ***C10G 21/00*** | (2006.01) |

(52) U.S. Cl.

CPC ..... *C10G 65/043* (2013.01); *C10G 67/0454* (2013.01); *C10G 69/02* (2013.01); *C10G 69/04* (2013.01); *C10G 73/06* (2013.01); *C10G 73/44* (2013.01); *C10M 1/00* (2013.01); *C10G 2300/1062* (2013.01); *C10G 2300/1074* (2013.01); *C10G 2300/1077* (2013.01); *C10G 2300/301* (2013.01); *C10G 2300/302* (2013.01); *C10G 2300/304* (2013.01); *C10G 2400/10* (2013.01); *C10M 2203/1025* (2013.01); *C10N 2220/022* (2013.01); *C10N 2230/02* (2013.01)

(56) References Cited

U.S. PATENT DOCUMENTS

| | | | | | |
|---|---|---|---|---|---|
| 5,306,416 | A * | 4/1994 | Le | C10M 101/02 | 208/108 |
| 5,358,628 | A * | 10/1994 | Apelian | B01J 29/18 | 208/58 |
| 5,885,438 | A * | 3/1999 | Apelian | C10G 45/64 | 208/18 |
| 5,976,351 | A * | 11/1999 | Apelian | C10G 45/64 | 208/18 |
| 6,231,749 | B1 * | 5/2001 | Degnan | C10G 65/12 | 208/18 |
| 6,294,077 | B1 * | 9/2001 | Dougherty | C10M 101/02 | 208/111.35 |
| 7,214,307 | B2 * | 5/2007 | Miller | C10M 107/02 | 208/14 |
| 7,402,236 | B2 * | 7/2008 | Miller | C10G 45/64 | 208/24 |
| 8,012,342 | B2 * | 9/2011 | Kobayashi | C10G 45/64 | 208/133 |
| 8,138,133 | B2 * | 3/2012 | Suzuki | C10M 111/04 | 508/110 |
| 8,318,002 | B2 * | 11/2012 | Baillargeon | C10M 111/02 | 208/19 |
| 8,658,018 | B2 * | 2/2014 | Rosenbaum | C10M 111/04 | 208/18 |
| 8,702,968 | B2 * | 4/2014 | Boons | C10M 171/02 | 208/19 |
| 8,758,596 | B2 * | 6/2014 | Hayasaka | B01J 29/7261 | 208/133 |
| 9,284,500 | B2 * | 3/2016 | Kim | C10G 45/02 | |
| 9,637,692 | B2 * | 5/2017 | Nagayasu | C10G 45/64 | |
| 2007/0289897 | A1 * | 12/2007 | Carey | C10M 111/00 | 208/19 |
| 2011/0290702 | A1 * | 12/2011 | Germaine | C10M 111/04 | 208/19 |
| 2012/0217186 | A1 * | 8/2012 | Hayasaka | B01J 21/066 | 208/27 |
| 2015/0051429 | A1 * | 2/2015 | Nagayasu | C10G 45/64 | 585/253 |

* cited by examiner

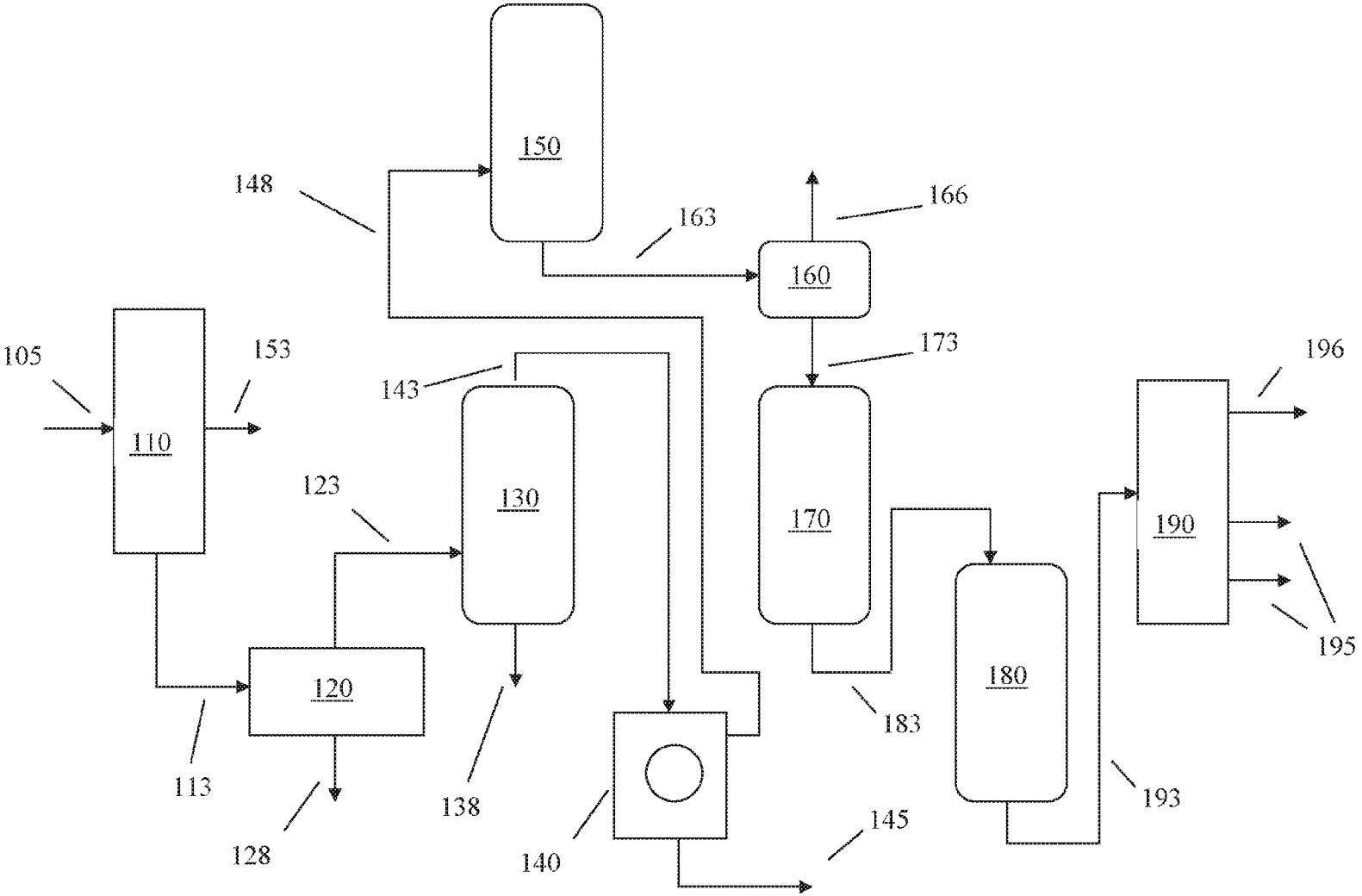
FIG 1/2

| Product Grade | | Case 1 | | | | | Case 2 | | | | |
|---|---|---|---|---|---|---|---|---|---|---|---|
| HDT 370°C+ Conversion, wt% | | 3 | | | | | 7 | | | | |
| Total Lube Yield (wt%) | | 80.20 | | | | | 78.30 | | | | |
| | | 2 cSt | 4 cSt | 6 cSt | 8 cSt | 16+ cSt | 2 cSt | 4 cSt | 6 cSt | 8 cSt | 16+ cSt |
| Yield on HDT Feed, wt% | | 9.40 | 6.40 | 3.90 | 8.10 | 52.40 | 11.50 | 7.40 | 4.40 | 8.30 | 46.70 |
| Product Property | Test Method | | | | | | | | | | |
| Density at 15 C, g/cc | ASTM D-4052 | 0.813 | 0.82 | 0.827 | 0.835 | 0.862 | 0.811 | 0.818 | 0.825 | 0.832 | 0.858 |
| Kinematic Viscosity at 100 C, cSt | ASTM D-445 | 2.18 | 4.18 | 5.79 | 8.00 | 17.69 | 2.22 | 4.21 | 5.81 | 8.01 | 16.96 |
| Kinematic Viscosity at 40 C, cSt | ASTM D-445 | 6.89 | 17.97 | 29.42 | 46.57 | 145.08 | 7.03 | 18.00 | 29.27 | 46.14 | 133.52 |
| Viscosity Index | ASTM D-2273 | 126.9 | 140.5 | 143.5 | 143.9 | 134.6 | 129.7 | 142.9 | 145.9 | 146.3 | 138 |
| Pour Point C | ASTM D-5950 | -29 | -19.1 | -16.3 | -15.1 | -18 | -29.2 | -19.5 | -16.7 | -15.5 | -18 |
| Flash Point, COC, C | ASTM D-92 | 167 | 219 | 244 | 266 | 343 | 168 | 219 | 244 | 266 | 331 |
| NOACK volatility, wt% | ASTM D-5800[1] | 75.8 | 14.5 | 4.5 | 1.4 | 0.1 | 73.6 | 14.5 | 4.4 | 1.4 | 0.2 |
| Aromatics, wt% | ASTM D-7419 | <1 | <1 | <1 | <1 | <1 | <1 | <1 | <1 | <1 | <1 |

FIG. 2/2

PRODUCTION OF BASE OILS FROM PETROLATUM

CROSS-REFERENCE TO RELATED APPLICATIONS

This application claims priority to U.S. application Ser. No. 14/196,050, filed Mar. 4, 2014, titled "Production of Base Oils from Petrolatum", the entirety of which is incorporated herein by reference, which claims priority to U.S. Provisional Application Ser. No. 61/781,785, filed Mar. 14, 2013 and is also herein incorporated by reference in its entirety.

FIELD

Systems and methods are provided for production of lubricant oil basestocks from waxy feeds.

BACKGROUND

One option for processing a vacuum resid portion of a feedstock is to perform a deasphalting process on the resid to form deasphalted oil. An aromatics extraction process can then be performed on the deasphalted oil to generate a brightstock raffinate. The brightstock raffinate can then be solvent dewaxed. This generates a dewaxed brightstock that is suitable for use as a lubricant base stock and a remaining waxy product that can be referred to as petrolatum. Conventionally, petrolatum has been used a feedstock for catalytic cracking processes to form fuels. Alternatively, petrolatum can be used as a microcrystalline wax product.

European Patent EP0788533B1 describes a wax hydroisomerization process for producing base oils. Petrolatum is identified as a potential feed for the process. When petrolatum is the feed, the petrolatum is initially hydrocracked to generate 15 wt %-25 wt % conversion of the feed. This conversion is relative to a conversion temperature of 650° F. (343° C.). The hydrocracked feed is then exposed to an isomerization catalyst, which is described as a large pore zeolite or silico-alumino phosphate molecular sieve with at least one 12-membered ring in the molecular sieve structure. Zeolite Beta, zeolite Y, and mordenite are provided as examples of large pore molecular sieves. The isomerization is described as having a conversion relative to 650° F. (343° C.) of 5 wt % to 30 wt %. In order to meet a desired pour point, the hydrotreated, isomerized feed can then be exposed to a dewaxing catalyst. The dewaxing catalysts are described as molecular sieves with 10-member rings in the molecular sieve structure, such as ZSM-22, ZSM-23, or ZSM-35. Dewaxing is described as causing an additional conversion loss of 10 wt % to 20 wt %. It is noted that the overall lubricant base oil yield is described as also being reduced based on the amount of wax remaining in the sample after the various processes. PCT Publication WO 96/07715 describes a similar type of hydroprocessing scheme.

SUMMARY

In an aspect, a method is provided for forming lubricant base oils. The method includes separating a feedstock into at least a first fraction and a bottoms fraction, a distillation cut point for separating the first fraction and the bottoms fraction being at least 950° F. (510° C.); deasphalting the bottoms fraction to form a deasphalted bottoms fraction and an asphalt product; extracting the deasphalted bottoms in the presence of an extraction solvent to form a raffinate stream and an extract stream, an aromatics content of the raffinate stream being lower than an aromatics content of the deasphalted bottoms; dewaxing the raffinate stream in the presence of a dewaxing solvent to form a lubricant base oil product and a waxy product having a wax content of at least 70 wt %; hydrotreating at least a portion of the waxy product under effective hydrotreating conditions to form a hydrotreated effluent, the effective hydrotreating conditions being effective for conversion of 10 wt % or less of a portion of the waxy product boiling above 700° F. (371° C.) to a portion boiling below 700° F. (371° C.); separating the hydrotreated effluent to form at least a liquid hydrotreated effluent; dewaxing the liquid hydrotreated effluent in the presence of a dewaxing catalyst under effective dewaxing conditions to form a dewaxed effluent, the effective dewaxing conditions being effective for conversion of 10 wt % to 35 wt % of a portion of the hydrotreated effluent boiling above 700° F. (371° C.) to a portion boiling below 700° F. (371° C.); and fractionating the dewaxed effluent to form a plurality of lubricant base oil products having a viscosity index of at least 120 and a pour point of −12° C. or less, the plurality of base oil products comprising at least a first base oil product having a lower pour point that a second base oil product, the first base oil product having a higher viscosity at 100° C. than the second base oil product.

In another aspect, a method is provided for forming lubricant base oils. The method includes providing a waxy feedstock having a T5 boiling point of at least at least 800° F. (427° C.), a T50 boiling point of at least 1000° F. (538° C.), and a wax content of at least 70 wt %; hydrotreating the waxy feedstock under effective hydrotreating conditions to form a hydrotreated effluent, the effective hydrotreating conditions being effective for conversion of 8 wt % or less of a portion of the waxy product boiling above 700° F. (371° C.) to a portion boiling below 700° F. (371° C.); separating the hydrotreated effluent to form at least a liquid hydrotreated effluent; dewaxing the liquid hydrotreated effluent in the presence of a dewaxing catalyst under effective dewaxing conditions to form a dewaxed effluent, the effective dewaxing conditions being effective for conversion of 10 wt % to 35 wt % of a portion of the hydrotreated effluent boiling above 700° F. (371° C.) to a portion boiling below 700° F. (371° C.); and fractionating the dewaxed effluent to form a plurality of lubricant base oil products having a viscosity index of at least 120 and a pour point of −15° C. or less, the plurality of base oil products comprising at least a first base oil product having a lower pour point that a second base oil product, the first base oil product having a higher viscosity at 100° C. than the second base oil product, the first base oil product and the second base oil product having a viscosity index of at least 130.

BRIEF DESCRIPTION OF THE DRAWINGS

FIG. 1 schematically shows an example of a configuration suitable for processing a feed to form lubricant base oils from petrolatum.

FIG. 2 shows results from processing of a petrolatum feed under various hydroprocessing conditions.

DETAILED DESCRIPTION

All numerical values within the detailed description and the claims herein are modified by "about" or "approximately" the indicated value, and take into account experimental error and variations that would be expected by a person having ordinary skill in the art.

Overview

In various embodiments, methods are provided for producing lubricant base oils from petrolatum. After solvent dewaxing of a brightstock raffinate to form a brightstock base oil, petrolatum is generated as a side product. Instead of using the petrolatum as a feed for cracking to form fuels, the petrolatum can be hydroprocessed to form base oils in high yield. The base oils formed from hydroprocessing of petrolatum have an unexpected pour point relationship. For a typical lubricant oil feedstock, the pour point of the base oils generated from the feedstock increases with the viscosity of the base oil. By contrast, lubricant base oils formed from hydroprocessing of petrolatum have a relatively flat pour point relationship, and some of the higher viscosity base oils can unexpectedly have lower pour points than lower viscosity base oils generated from the same petrolatum feed. The base oils generated from the petrolatum are also unusual in that hydroprocessing of petrolatum can generate base oils with both high viscosity (such as at least 8 cSt at 100° C.) and high viscosity index (such as at least 130 VI) while maintaining at least a 70% yield relative to the petrolatum feed. This desirable yield is achieved by hydrotreating the petrolatum under conditions that result in a low or minimal amount of conversion, followed by catalytic dewaxing using a molecular sieve with a 10-member ring pore size, such as ZSM-48.

Group I basestocks or base oils are defined as base oils with less than 90 wt % saturated molecules and/or at least 0.03 wt % sulfur content. Group I basestocks also have a viscosity index (VI) of at least 80 but less than 120. Group II basestocks or base oils contain at least 90 wt % saturated molecules and less than 0.03 wt % sulfur. Group II basestocks also have a viscosity index of at least 80 but less than 120. Group III basestocks or base oils contain at least 90 wt % saturated molecules and less than 0.03 wt % sulfur, with a viscosity index of at least 120. In addition to the above formal definitions, some Group I basestocks may be referred to as a Group I+ basestock, which corresponds to a Group I basestock with a VI value of 103 to 108. Some Group II basestocks may be referred to as a Group II+ basestock, which corresponds to a Group II basestock with a VI of at least 113. Some Group III basestocks may be referred to as a Group III+ basestock, which corresponds to a Group III basestock with a VI value of at least 130.

Conventionally, a feedstock for lubricant base oil production is processed either using solvent dewaxing or using catalytic dewaxing. For example, in a lube solvent plant, a vacuum gas oil (VGO) or another suitable feed is fractionated into light neutral (LN) and heavy neutral (HN) distillates and a bottom fraction by some type of vacuum distillation. The bottoms fraction is subsequently deasphalted to recover an asphalt fraction and a brightstock. The LN distillate, HN distillate, and brightstock are then solvent extracted to remove the most polar molecules as an extract and corresponding LN distillate, HN distillate, and brightstock raffinates. The raffinates are then solvent dewaxed to obtain a LN distillate, HN distillate, and brightstock basestocks with acceptable low temperature properties. It is beneficial to hydrofinish the lubricant basestocks either before or after the solvent dewaxing step. The resulting lubricant basestocks may contain a significant amount of aromatics (up to 25%) and high sulfur (>300 ppm). Thus, the typical base oils formed from solvent dewaxing alone are Group I basestocks. As an alternative, a raffinate hydroconversion step can be performed prior to the solvent dewaxing. The hydroconversion is essentially a treatment under high $H_2$ pressure in presence of a metal sulfide based hydroprocessing catalyst which remove most of the sulfur and nitrogen. The amount of conversion in the hydroconversion reaction is typically tuned to obtain a predetermined increase in viscosity index and 95%+ saturates. This allows the solvent dewaxed lubricant basestock products to be used as Group II or Group II+ basestocks. Optionally, the wax recovered from a solvent dewaxing unit may also be processed by catalytic dewaxing to produce Group III or Group III+ lubricant basestocks.

For production of lubricant base oils in an all catalytic process, a VGO (or another suitable feed) is hydrocracked under medium pressure conditions to obtain a hydrocracker bottoms with reduced sulfur and nitrogen contents. One or more LN and/or HN distillate fractions may then be recovered from the desulfurized hydrocracker bottoms. The recovered fractions are then catalytically dewaxed, such as by using a shape selective dewaxing catalyst, followed by hydrofinishing. This process typically results in production of Group II, Group II+, and Group III base oils. However, due to the conversion in the hydrocracker, the amount of heavy neutral base oils that are produced is limited.

In various aspects, lubricant base oils can be generated by using a combination of a solvent dewaxing process and a catalytic dewaxing process. Solvent processing can be used to form a brightstock raffinate. This brightstock raffinate can then be solvent dewaxed to form a brightstock basestock and petrolatum. The petrolatum can then be hydroprocessed to form additional lubricant base oils. For example, the petrolatum can be hydrotreated to remove sulfur and/or nitrogen. The hydrotreated feed can then be catalytically dewaxed and hydrofinished to form a plurality of lubricant base oils.

Feedstocks

A wide range of petroleum and chemical feedstocks can be processed in accordance with the disclosure. Suitable feedstocks include whole and reduced petroleum crudes, atmospheric and vacuum residua, and deasphalted residua, e.g., brightstock. Other feedstocks can also be suitable, so long as the feedstock includes an appropriate fraction for formation of a brightstock.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T50" boiling point is a temperature at 50 wt % of the feed will boil. The percentage of a feed that will boil at a given temperature can be determined by the method specified in ASTM D2887.

Typical feeds for distillation to form a vacuum resid fraction include, for example, feeds with an initial boiling point of at least 650° F. (343° C.), or at least 700° F. (371° C.), or at least 750° F. (399° C.). Alternatively, a feed may be characterized using a T5 boiling point, such as a feed with a T5 boiling point of at least 650° F. (343° C.), or at least 700° F. (371° C.), or at least 750° F. (399° C.).

In other aspects, a feed may be used that is a vacuum resid or bottoms fraction, or that otherwise contains a majority of molecules that are typically found in a vacuum resid. Such feeds include, for example, feeds with an initial boiling point of at least 800° F. (427° C.), or at least 850° F. (454° C.), or at least 900° F. (482° C.), or at least 950° F. (510° C.), or at least 1000° F. (538° C.). Alternatively, a feed may be characterized using a T5 boiling point, such as a feed with a T5 boiling point of at least 800° F. (427° C.), or at least 850° F. (454° C.), or at least 900° F. (482° C.), or at least 950° F. (510° C.), or at least 1000° F. (538° C.). It is noted that feeds with still lower initial boiling points and/or T5 boiling points may also be suitable, so long as sufficient higher boiling material is available so that a brightstock raffinate can be formed and subsequently solvent dewaxed. A suitable vacuum resid feed can also have a T50 boiling point of at least 1000° F. (538° C.), or at least 1050° F. (566° C.), or at least 1100° F. (593° C.).

If a broader boiling range feed is used, the feedstock can initially be distilled to form a vacuum resid. The cut point for separating the vacuum resid from other distillate portions of the feed can correspond to any of the T5 boiling points described above. The vacuum resid can then be deasphalted to form a deasphalted oil. The deasphalted oil can then be solvent processed to extract aromatics. This results in a brightstock raffinate and a brightstock extract. The brightstock raffinate can then be solvent dewaxed to form a brightstock basestock and petrolatum. The petrolatum can have a wax content of at least 70 wt %, such as at least 75 wt %, or at least 80 wt %.

In some aspects, the sulfur content of the feed can be at least 300 ppm by weight of sulfur, or at least 1000 wppm, or at least 2000 wppm, or at least 4000 wppm, or at least 10,000 wppm, or at least 20,000 wppm. In other embodiments, including some embodiments where a previously hydrotreated and/or hydrocracked feed is used, the sulfur content can be 2000 wppm or less, or 1000 wppm or less, or 500 wppm or less, or 100 wppm or less.

It is noted that Fischer-Tropsch waxes and other synthetic waxes are not included within the feedstock description. When a Fischer-Tropsch was (or other synthetic wax) is processed according to the methods described below, the resulting lubricant base oil products can appear to have "haze" in the base oil. By contrast, the base oils derived from hydroprocessing of petrolatum as described herein do not exhibit haze.

Solvent Processing to Form Petrolatum

One of the fractions formed during vacuum distillation of the feedstock is a bottoms portion or resid portion. This bottoms portion can include a variety of types of molecules, including asphaltenes. Solvent deasphalting can be used to separate asphaltenes from the remainder of the bottoms portion. This results in a deasphalted bottoms fraction and an asphalt or asphaltene fraction.

Solvent deasphalting is a solvent extraction process. Typical solvents include alkanes or other hydrocarbons containing 3 to 6 carbons per molecule. Examples of suitable solvents include propane, n-butane, isobutene, and n-pentane. Alternatively, other types of solvents may also be suitable, such as supercritical fluids. During solvent deasphalting, a feed portion is mixed with the solvent. Portions of the feed that are soluble in the solvent are then extracted, leaving behind a residue with little or no solubility in the solvent. Typical solvent deasphalting conditions include mixing a feedstock fraction with a solvent in a weight ratio of from 1:2 to 1:10, such as 1:8 or less. Typical solvent deasphalting temperatures range from 40° C. to 150° C. The pressure during solvent deasphalting can be from 50 psig (345 kPag) to 500 psig (3447 kPag).

The portion of the deasphalted feedstock that is extracted with the solvent is often referred to as deasphalted oil. In various aspects, the bottoms from vacuum distillation can be used as the feed to the solvent deasphalter, so the portion extracted with the solvent can also be referred to as deasphalted bottoms. The yield of deasphalted oil from a solvent deasphalting process varies depending on a variety of factors, including the nature of the feedstock, the type of solvent, and the solvent extraction conditions. A lighter molecular weight solvent such as propane will result in a lower yield of deasphalted oil as compared to n-pentane, as fewer components of a bottoms fraction will be soluble in the shorter chain alkane. However, the deasphalted oil resulting from propane deasphalting is typically of higher quality, resulting in expanded options for use of the deasphalted oil. Under typical deasphalting conditions, increasing the temperature will also usually reduce the yield while increasing the quality of the resulting deasphalted oil. In various embodiments, the yield of deasphalted oil from solvent deasphalting can be 85 wt % or less of the feed to the deasphalting process, or 75 wt % or less. Preferably, the solvent deasphalting conditions are selected so that the yield of deasphalted oil is at least 65 wt %, such as at least 70 wt % or at least 75 wt %. The deasphalted bottoms resulting from the solvent deasphalting procedure are then combined with the higher boiling portion from the vacuum distillation unit for solvent processing.

After a deasphalting process, the yield of deasphalting residue is typically at least 15 wt % of the feed to the deasphalting process, but is preferably 35 wt % or less, such as 30 wt % or less or 25 wt % or less. The deasphalting residue can be used, for example, for making various grades of asphalt.

Two types of solvent processing can be performed on the combined higher boiling portion from vacuum distillation and the deasphalted bottoms. The first type of solvent processing is a solvent extraction to reduce the aromatics content and/or the amount of polar molecules. The solvent extraction process selectively dissolves aromatic components to form an aromatics-rich extract phase while leaving the more paraffinic components in an aromatics-poor raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting distillate to be extracted with solvent, one can control the degree of separation between the extract and raffinate phases. Any convenient type of liquid-liquid extractor can be used, such as a counter-current liquid-liquid extractor. Depending on the initial concentration of aromatics in the deasphalted bottoms, the raffinate phase can have an aromatics content of 5 wt % to 25 wt %. For typical feeds, the aromatics contents will be at least 10 wt %.

In some alternative aspects, the deasphalted bottoms and the higher boiling fraction from vacuum distillation can be solvent processed together. Alternatively, the deasphalted bottoms and the higher boiling fraction can be solvent processed separately, to facilitate formation of different types of lubricant base oils. For example, the higher boiling fraction from vacuum distillation can be solvent extracted and then solvent dewaxed to form a Group I base oil while the deasphalted bottoms are solvent processed to form a brightstock. Of course, multiple higher boiling fractions could also be solvent processed separately if more than one distinct Group I base oil and/or brightstock is desired.

In some aspects, the raffinate from the solvent extraction can be an under-extracted raffinate. In such aspects, the extraction is carried out under conditions such that the raffinate yield is maximized while still removing most of the lowest quality molecules from the feed. Raffinate yield may be maximized by controlling extraction conditions, for example, by lowering the solvent to oil treat ratio and/or decreasing the extraction temperature. The raffinate from the solvent extraction unit can then be solvent dewaxed under solvent dewaxing conditions to remove hard waxes from the raffinate.

Solvent dewaxing typically involves mixing the raffinate feed from the solvent extraction unit with chilled dewaxing solvent to form an oil-solvent solution. Precipitated wax is thereafter separated by, for example, filtration. The temperature and solvent are selected so that the oil is dissolved by the chilled solvent while the wax is precipitated. The precipitated wax corresponds to petrolatum that can subsequently be hydroprocessed to form lubricant base oils.

An example of a suitable solvent dewaxing process involves the use of a cooling tower where solvent is prechilled and added incrementally at several points along the height of the cooling tower. The oil-solvent mixture is agitated during the chilling step to permit substantially instantaneous mixing of the prechilled solvent with the oil. The prechilled solvent is added incrementally along the length of the cooling tower so as to maintain an average chilling rate at or below 10° F. per minute, usually between 1 to 5° F. per minute. The final temperature of the oil-solvent/precipitated wax mixture in the cooling tower will usually be between 0 and 50° F. (−17.8 to 10° C.). The mixture may then be sent to a scraped surface chiller to separate precipitated wax from the mixture.

Representative dewaxing solvents are aliphatic ketones having 3-6 carbon atoms such as methyl ethyl ketone and methyl isobutyl ketone, low molecular weight hydrocarbons such as propane and butane, and mixtures thereof. The solvents may be mixed with other solvents such as benzene, toluene or xylene.

In general, the amount of solvent added will be sufficient to provide a liquid/solid weight ratio between the range of 5/1 and 20/1 at the dewaxing temperature and a solvent/oil volume ratio between 1.5/1 to 5/1. The solvent dewaxed oil is typically dewaxed to an intermediate pour point, preferably less than +10° C., such as less than 5° C. or less than 0° C. The resulting solvent dewaxed oil is suitable for use in forming one or more types of Group I base oils. The aromatics content will typically be greater than 10 wt % in the solvent dewaxed oil. Additionally, the sulfur content of the solvent dewaxed oil will typically be greater than 300 wppm.

Hydroprocessing of Petrolatum

After producing a petrolatum fraction by solvent dewaxing (or otherwise obtaining a petrolatum fraction), the petrolatum can be hydroprocessed to form lubricant basestocks with unexpectedly high yields. The lubricant basestocks can also have unexpected properties in relation to each other, such as generating a first basestock that has both a higher viscosity and a higher pour point than a second basestock generated by from the same hydroprocessed petrolatum fraction. Due to some conversion of the petrolatum feed to lower boiling products, a diesel fraction can also be generated.

In this discussion, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

In the discussion herein, reference will be made to a hydroprocessing reaction system. The hydroprocessing reaction system corresponds to the one or more stages, such as two stages and/or reactors and an optional intermediate separator, that are used to expose a feed to a plurality of catalysts under hydroprocessing conditions. The plurality of catalysts can be distributed between the stages and/or reactors in any convenient manner, with some preferred methods of arranging the catalyst described herein.

After forming (or obtaining) a petrolatum fraction, the petrolatum feed is passed into a hydroprocessing reaction system. The hydroprocessing of the petrolatum can include at least a hydrotreatment stage and a catalytic dewaxing stage. In many aspects, a hydrofinishing or aromatic saturation stage can also be included after catalytic dewaxing. A separator can be used between a hydrotreatment stage and a catalytic dewaxing stage, such as a high temperature separator, to allow for removal of $H_2$, $NH_3$, and/or other contaminant gases and light ends in between the stages of the reaction system. Optionally, the hydrofinishing catalyst can be included as part of a final bed in the final dewaxing stage of the reaction system.

During hydroprocessing, conversion of the feed can occur relative to a conversion temperature. For example, the amount of conversion in the feed can be characterized based on the amount of conversion of components boiling above a conversion temperature, such as 700° F. (371° C.), to components boiling below the conversion temperature. The amount of conversion can be expressed relative to the input feed for a particular process. Thus, for a process where conversion occurs in both the hydrotreatment and catalytic dewaxing stages, a first amount of conversion can refer to conversion in the hydrotreatment process. This conversion is relative to the amount of material with a boiling point above 700° F. (371° C.) in the feed to the hydrotreatment process. A second conversion can refer to conversion of the hydrotreated effluent in the dewaxing stage. Instead of expressing this conversion relative to the feed to the hydrotreatment process, this conversion is expressed relative to the content of the hydrotreated effluent that enters the dewaxing stage.

The final product after hydroprocessing can then be fractionated to form lubricant base oils. The yield of lubricant base oils can be expressed relative to the feed into the first hydroprocessing step, or relative to the effluent from the hydrotreatment stages. The yield of lubricant base oil can be less than the original feed due to at least two factors. First, for the portion of the feed that is converted relative to lower boiling components, any portion of the feed that is converted to a boiling range of 650° F. (343° C.) or less is no longer suitable for use as a lubricant, and instead can be separated out for use as part of a fuel or light ends fraction. Second, any wax in the feed that is not converted and/or is not otherwise reacted during dewaxing may also not be suitable for inclusion in a lubricant base oil fraction. In various embodiments, the severity of the catalytic dewaxing step can be sufficient to reduce or minimize the amount of wax that remains unconverted and unreacted after hydroprocessing. By contrast, in some conventional methods for treating high wax content feeds, the yield of lubricating base oil may be reduced due to the presence of unconverted and unreacted wax.

Hydrotreatment Conditions

In some aspects, at least a first stage of the reaction system can correspond to a hydrotreatment stage. In a hydrotreatment stage, the petrolatum is exposed to a hydrotreating catalyst under effective conditions for removing heteroatoms and/or for performing a mild conversion of the feed relative to a conversion temperature of 370° C. In some aspects, the effective conditions can be selected so that the amount of conversion of petrolatum relative to a 370° C. conversion temperature is 10 wt % or less, such as 18 wt % or less, or 5 wt % or less. Additionally or alternately, the amount of conversion relative to a 370° C. conversion temperature can be at least 1 wt %, or at least 1.5 wt %. It is noted that the methods described herein allow for a reduced or minimized amount of conversion of the petrolatum feed during reaction stages prior to the catalytic dewaxing stage. By reducing the amount of conversion that is performed prior to catalytic dewaxing, the overall yield of lubricant base oil can be improved.

Hydrotreatment is typically used to reduce the sulfur, nitrogen, and aromatic content of a feed. The catalysts used for hydrotreatment of the heavy portion of the crude oil from the flash separator can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base oil) boiling range feed in a conventional manner may be used. It is within the scope of the present disclosure that more than one type of hydroprocessing catalyst can be used in one or multiple reaction vessels.

The at least one Group VIII non-noble metal, in oxide form, can typically be present in an amount ranging from 2 wt % to 40 wt %, preferably from 4 wt % to 15 wt %. The at least one Group VI metal, in oxide form, can typically be present in an amount ranging from 2 wt % to 70 wt %, preferably for supported catalysts from 6 wt % to 40 wt % or from 10 wt % to 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this disclosure, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least 50 vol. % and more preferably at least 75 vol. % hydrogen.

Hydrogen can be supplied at a rate of from 100 SCF/B (standard cubic feet of hydrogen per barrel of feed) (17 $Nm^3/m^3$) to 1500 SCF/B (253 $Nm^3/m^3$). Preferably, the hydrogen is provided in a range of from 200 SCF/B (34 $Nm^3/m^3$) to 1200 SCF/B (202 $Nm^3/m^3$). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

In addition to or as an alternative to exposing the petrolatum to a hydrotreating catalyst, the petrolatum can be exposed to one or more beds of hydrocracking catalyst. The hydrocracking conditions can be selected so that the total conversion from all hydrotreating and/or hydrocracking stages is 15 wt % or less, or 10 wt % or less, or 8 wt % or less, as described above.

Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Non-limiting examples of metals for hydrocracking catalysts include nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

In various aspects, the conditions selected for hydrocracking can depend on the desired level of conversion, the level of contaminants in the input feed to the hydrocracking stage, and potentially other factors. A hydrocracking process can be carried out at temperatures of 550° F. (288° C.) to 840° F. (449° C.), hydrogen partial pressures of from 250 psig to 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of 600° F. (343° C.) to 815° F. (435° C.), hydrogen partial pressures of from 500 psig to 3000 psig (3.5 MPag-20.9 MPag), and hydrogen treat gas rates of from 213 $m^3/m^3$ to 1068 $m^3/m^3$ (1200 SCF/B to 6000 SCF/B). The LHSV relative to only the hydrocracking catalyst can be from 0.25 $h^{-1}$ to 50 $h^{-1}$, such as from 0.5 $h^{-1}$ to 20 $h^{-1}$, and preferably from 1.0 $h^{-1}$ to 4.0 $h^{-1}$ In some aspects, a high pressure stripper (or another type of separator) can then be used in between the hydrotreatment stages and catalytic dewaxing stages of the reaction system to remove gas phase sulfur and nitrogen contaminants. Additionally or alternately, a stripper or other separator can be used between hydrotreatment stages. A separator allows contaminant gases formed during hydrotreatment (such as $H_2S$ and $NH_3$) to be removed from the reaction system prior to passing the processed effluent into a later stage of the reaction system. One option for the separator is to simply perform a gas-liquid separation to remove contaminants. Another option is to use a separator such as a flash separator that can perform a separation at a higher temperature.

Catalytic Dewaxing Process

In order to improve the quality of lubricant base oils produced from the petrolatum, at least a portion of the catalyst in a reaction stage can be a dewaxing catalyst. Typically, the dewaxing catalyst is located in a bed downstream from any hydrotreatment catalyst stages and/or any hydrotreatment catalyst present in a stage. This can allow the dewaxing to occur on molecules that have already been hydrotreated to remove a significant fraction of organic sulfur- and nitrogen-containing species.

Suitable dewaxing catalysts can include molecular sieves such as crystalline aluminosilicates (zeolites). In an embodiment, the molecular sieve can comprise, consist essentially of, or be a molecular sieve having a structure with 10-member rings or smaller, such as ZSM-22, ZSM-23, ZSM-35 (or ferrierite), ZSM-48, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, ZSM-23, or a combination thereof. Additionally or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from 20:1 to 40:1 can sometimes be referred to as SSZ-32. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the disclosure are catalysts with a low ratio of silica to alumina. For example, for ZSM-48, the ratio of silica to alumina in the zeolite can be less than 200:1, such as less than 110:1, or less than 100:1, or less than 90:1, or less than 75:1. In various embodiments, the ratio of silica to alumina can be from 50:1 to 200:1, such as 60:1 to 160:1, or 70:1 to 100:1.

In various embodiments, the catalysts according to the disclosure further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the disclosure can also include a binder. In some embodiments, the dewaxing catalysts used in process according to the disclosure are formulated using a low surface area binder, where a low surface area binder represents a binder with a surface area of 100 $m^2/g$ or less, or 80 $m^2/g$ or less, or 70 $m^2/g$ or less. The amount of zeolite in a catalyst formulated using a binder can be from 30 wt % zeolite to 90 wt % zeolite relative to the combined weight of binder and zeolite. Preferably, the amount of zeolite is at least 50 wt % of the combined weight of zeolite and binder, such as at least 60 wt % or from 65 wt % to 80 wt %.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Process conditions in a catalytic dewaxing zone can include a temperature of from 200 to 450° C., preferably 270 to 400° C., a hydrogen partial pressure of from 1.8 MPag to 34.6 MPag (250 psig to 5000 psig), preferably 4.8 MPag to 20.8 MPag, and a hydrogen circulation rate of from 35.6 $m^3/m^3$ (200 SCF/B) to 1781 $m^3/m^3$ (10,000 scf/B), preferably 178 $m^3/m^3$ (1000 SCF/B) to 890.6 $m^3/m^3$ (5000 SCF/B). In still other embodiments, the conditions can include temperatures in the range of 600° F. (343° C.) to 815° F. (435° C.), hydrogen partial pressures of from 500 psig to 3000 psig (3.5 MPag-20.9 MPag), and hydrogen treat gas rates of from 213 $m^3/m^3$ to 1068 $m^3/m^3$ (1200 SCF/B to 6000 SCF/B). The liquid hourly space velocity (LHSV) can be from 0.2 $h^{-1}$ to 10 $h^{-1}$, such as from 0.5 $h^{-1}$ to 5 $h^{-1}$ and/or from 1 $h^{-1}$ to 4 $h^{-1}$. Preferably, the process conditions can be selected to achieve a desired level of conversion of the hydrotreated effluent relative to a conversion temperature of 370° C. In some aspects, the amount of conversion relative to 370° C. during the catalytic dewaxing stage(s) is at least 15 wt %, such as at least 20 wt %. Additionally or alternately, the amount of conversion relative to 370° C. can be 35 wt % or less, such as 30 wt % or less. Increasing the amount of conversion can improve the cold flow properties of the resulting basestocks. Additionally, increasing the amount of conversion can increase the amount of lower viscosity basestocks. However, increasing the conversion can also reduce the overall yield of lubricant basestocks relative to the petrolatum feed. One of the unexpected advantages achieved from producing basestocks from a petrolatum feed is the ability to achieve yields of at least 70% relative to the petrolatum feed, such as at least 75 wt %. It is noted that the amount of conversion relative to (700° F.) 371° C. is not equivalent to the loss of yield due to conversion, as products that are converted to a boiling range between 650° F. (343° C.) and 700° F. (371° C.) are still suitable for inclusion in a low viscosity base oil.

Hydrofinishing and/or Aromatic Saturation Process

In some aspects, a hydrofinishing and/or aromatic saturation stage can also be provided. The hydrofinishing and/or aromatic saturation can occur after the last dewaxing stage. The hydrofinishing and/or aromatic saturation can occur either before or after fractionation. If hydrofinishing and/or aromatic saturation occurs after fractionation, the hydrofinishing can be performed on one or more portions of the fractionated product, such as being performed on the basestock fractions having a viscosity of 6 cSt or less at 100° C., the fractions having a viscosity of 8 cSt or more at 100° C., or on any other convenient portion(s) of the basestock fractions produced after fractionation. Alternatively, the entire effluent from the last dewaxing process stage can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing. Typically a hydrofinishing and/or aromatic saturation process will be performed in a separate reactor from dewaxing or processes for practical reasons, such as facilitating use of a lower temperature for the hydrofinishing or aromatic saturation process. However, an additional hydrofinishing reactor following a dewaxing process but prior to fractionation could still be considered part of a second stage of a reaction system conceptually.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from 125° C. to 425° C., preferably 180° C. to 280° C., a hydrogen partial pressure from 500 psig (3.4 MPa) to 3000 psig (20.7 MPa), preferably 1500 psig (10.3 MPa) to 2500 psig (17.2 MPa), and liquid hourly space velocity from 0.1 $hr^{-1}$ to 5 $hr^{-1}$ LHSV, preferably 0.5 $hr^{-1}$ to 1.5 $hr^{-1}$. Additionally, a hydrogen treat gas rate of from 35.6 $m^3/m^3$ to 1781 $m^3/m^3$ (200 SCF/B to 10,000 SCF/B) can be used.

Product Properties after Hydroprocessing

After hydroprocessing, the resulting hydroprocessed petrolatum effluent can be fractionated to form a variety of base oils. Based in part on the initial high boiling point, waxy nature of the feed, and based in part on the conversion performed during hydrotreatment and dewaxing, the hydroprocessed petrolatum effluent can be fractionated to form a plurality of base oils at different viscosities. For example, a hydroprocessed petrolatum effluent can be fractionated to form base oils that roughly correspond to a 2 cSt base oil, a 4 cSt base oil, a 6 cSt base oil, an 8 cSt base oil, and a 16 cSt base oil. Of course, any other convenient fractionation into a plurality of base oils can also be used in order to generate a desired target slate of basestocks.

The basestocks generated from the hydroprocessed petrolatum effluent can have a viscosity index (VI) of at least 120, such as at least 130 or at least 140. In some aspects, a 2 cSt type basestock derived from the hydroprocessed petrolatum effluent can have a VI of at least 120 while one or more other basestocks with higher viscosities can be generated that have a VI of at least 130 or at least 140. Because the hydroprocessing can include hydrotreating of the petrolatum to reduce sulfur and/or aromatics content within the hydroprocessed effluent, the basestocks generated from the hydroprocessed petrolatum effluent can correspond to Group III or Group III+ type basestocks.

In addition to providing a plurality of basestocks with desirable VI, the basestocks derived from a hydroprocessed petrolatum effluent can also have unexpected pour point relationships. For a conventional lubricant base oil production process, it would be expected that the higher viscosity base oils generated from a feed would also have higher pour points. By contrast, the base oils derived from hydroprocessed petrolatum can have similar pour point values between some higher and lower viscosity fractions. Additionally, some higher viscosity basestocks can have a lower pour point than a lower viscosity basestock generated from the same petrolatum feed. This unexpected pour point behavior for the higher viscosity basestocks can contribute to the improved lubricant basestock yields from a petrolatum feed, as increased severity hydroprocessing is not needed to improve the cold flow properties of the higher viscosity products. For example a first base oil product can have a viscosity of at least 7.5 cSt at 100° C., such as at least 8.0 cSt. Optionally, the first base oil product can have a viscosity of at least 12.0 cSt, such as at least 16.0 cSt. A second base oil product can have a lower viscosity than the first base oil product, with the viscosity being at least 3.5 cSt at 100° C., such as at least 4.0 cSt. For such a first and second base oil, the pour point of the first base oil product can equal to or (preferably lower than a pour point for the second base oil product. The first and second base oils can each have a viscosity index of at least 120, and preferably at least 130, such as at least 135 or at least 140.

In various aspects, the yield of lubricant basestock relative to a hydrotreated petrolatum feed can be at least 70 wt %, such as at least 75 wt % or at least 80 wt %. Additionally or alternately, the overall yield of lubricant basestock relative to the petrolatum feed prior to hydroprocessing can be at least 65 wt %, such as at least 70 wt % or at least 75 wt %.

In aspects where the petrolatum is obtained by forming petrolatum as part of solvent processing of a vacuum resid (or other suitable feed), still another product can be one or more Group I base oils that are generated from the solvent dewaxing process. These Group I base oils can be generated from the dewaxed brightstock raffinate that is formed during the solvent dewaxing process that is used to form the petrolatum. The base oils derived from the solvent dewaxed brightstock raffinate can often be Group I base oils due to the fact that the solvent dewaxed brightstock raffinate has not been hydroprocessed to remove sulfur.

Still another product generated during hydroprocessing of the petrolatum is low pour point diesel. Some of the conversion of products during hydrotreating and/or dewaxing results in formation of lower viscosity base oils at the expense of higher viscosity base oils. However, the conversion during hydrotreating and/or dewaxing also results in formation of products outside of the lubricant base oil boiling range. These products, which can have boiling points of 650° F. (343° C.) or less, can instead be suitable for use as a low pour point diesel fuel. In some aspects, naphtha and light ends products can also be generated.

Example of Configuration for Integrated Reaction System

FIG. 1 shows a schematic example of a configuration for forming lubricant base oils by hydroprocessing of a petrolatum fraction. In the embodiment shown in FIG. 1, a feedstock for lubricant base oil production 105 is introduced into a vacuum distillation tower 110. The vacuum distillation tower 110 fractionates the feedstock 105 into at least a distillate boiling range portion 153 and a bottoms portion 113. The bottoms portion 113 is passed into a deasphalter 120 for solvent deasphalting. This results in an asphalt output 128 and a deasphalted bottoms stream (brightstock) 123. The deasphalted bottoms 123 are then solvent extracted 130. This results in an aromatics-rich extract 138 and a raffinate 143 with reduced aromatics content. The raffinate 143 is then solvent dewaxed 140 to form a wax output (petrolatum) 148 and Group I heavy neutral and/or brightstock base oils 145. Optionally, solvent extraction process 130 and/or solvent dewaxing process 140 can represent a plurality of solvent extraction and/or dewaxing units.

In the configuration shown in FIG. 1, the wax or petrolatum output from solvent dewaxing unit 148 is then passed into a first hydroprocessing stage 150. The petrolatum is exposed to one or more hydroprocessing catalyst in the presence of hydrogen. As shown in FIG. 1, the effluent 163 from first hydroprocessing stage 150 is passed into a high pressure stripper (or other separator) 160. For example, stripper 160 can be a gas-liquids separator the separates the gas phase portion 166 of the effluent from the liquid portion 173 of the effluent.

The liquid effluent 173 from stripper 160 is then passed into second hydroprocessing stage 170. In the configuration shown in FIG. 1, the second hydroprocessing stage includes at least a portion of dewaxing catalyst. The effluent 183 from the second hydroprocessing stage 170 is then optionally hydrofinished in a hydrofinishing stage 180. The effluent 193 from the optional hydrofinishing stage can then be fractionated to generate, for example, a plurality of lubricant base oil fractions 195 and one or more fuels (naphtha or diesel) fractions 196. This lubricant base oil portion(s) corresponds to Group III and/or Group III+ lubricant base oil portions.

EXAMPLES

Example 1—Hydroprocessing of Petrolatum

A petrolatum feed was hydroprocessed in a reaction system that includes a hydrotreatment stage, a catalytic dewaxing stage, and a hydrofinishing stage. In this example, a petrolatum feed is hydrotreated under mild conditions. The total liquid product from hydrotreating is then dewaxed and hydrofinished prior to fractionation to form a plurality of lubricant base oil products.

Table 1 shows various properties of the petrolatum feed. The petrolatum was generated by solvent processing (deasphalting, aromatics extraction, solvent dewaxing) of a vacuum resid feed. Properties of the solvent dewaxed oil that was formed as the other product from solvent dewaxing are shown at the bottom of Table 1. As shown in Table 1, only 5 wt % of the feed boils at 450° C. or less, and the majority of the feed has a boiling point greater than 550° C.

TABLE 1

| Petrolatum feed properties | |
|---|---|
| Quality | Value |
| Density @15° C. (kg/m$^3$) | 859.2 |
| API | |
| Sulfur, wt % | 0.2993 |
| Nitrogen, wppm | 163 |
| Total Aromatics, mmole/kg | 253 |
| Estimated Aromatics (MW = 660) | 16.7 |
| KV100, cSt | 14.15/13.97 |
| KV70, cSt | |
| KV80, cSt | 23.35/23.02 |
| VI | 155 |
| D2887 5%, ° C. | 449 |
| D2887 50%, ° C. | 561 |
| D2887 95%, ° C. | 672 |
| Dry Wax, wt % | 78.3 |
| Solvent Dewaxed Oil | |
| KV100, cSt | 23.726 |
| KV40, cSt | 332 |
| VI | 90.5 |
| Pour Point, ° C. | −13 |

Table 2 shows the reaction conditions used for the hydrotreatment, catalytic dewaxing, and hydrofinishing stages in the reaction system. The hydrotreatment catalyst was a commercially available supported NiMo hydrotreating catalyst. After hydrotreatment, a stripper was used to remove contaminant gases from the effluent before passing the effluent into the dewaxing stage. The treat gas exiting the hydrotreatment stage was used as the input treat gas for the dewaxing stage. The dewaxing catalyst was an alumina bound ZSM-48 with a $SiO_2$:$Al_2O_3$ ratio of less than 100:1. 0.6 wt % of Pt was also supported on the dewaxing catalyst. The hydrofinishing catalyst was an alumina bound MCM-41 catalyst with 0.3 wt % of Pd and 0.9 wt % of Pt supported on the catalyst. Table 2 also shows the amount of conversion of the petrolatum feed that occurred relative to a 370° C. boiling point within each stage. (In other words, the amount of feed that originally had a boiling point greater than 370° C. that is converted to product with a boiling point below 370° C.). The conversion amounts are for each stage, so that the 29 wt % conversion shown for the dewaxing stage in Table 2 represents 29 wt % conversion of the effluent from the hydrotreatment stage. Note that in Table 2, 134 kg (force)/cm$^2$ corresponds to 13.1 MPag.

TABLE 2

Hydroprocessing Conditions

| Reactor | HDT | HDW | HDF |
|---|---|---|---|
| HDT 370° C. + Conversion, wt % | 2.5 | 29 | nil |
| Reactor LHSV, hr$^{-1}$ | 0.45 | 0.675 | 1.0 |
| Average Reactor Temperature, ° C. | 335 | 340 | 220 |
| Treat Gas Rate at HDT Reactor Inlet (min), Nm$^3$-H$^2$/Sm$^3$ | 420 | 420 | 420 |
| Hydrogen Partial Pressure (min), Kg (force)/cm$^2$(a) | 134 | 134 | 134 |

Table 3 shows a plurality of base oils that were generated from the hydroprocessed petrolatum effluent that was formed by hydroprocessing the petrolatum feed in Table 1 under the hydroprocessing conditions shown in Table 2. In this example, the hydroprocessed petrolatum effluent was fractionated to form a 2 cSt base oil, a 4 cSt base oil, a 6 cSt base oil, an 8 cSt base oil, and a 16 (or greater) cSt base oil. As shown in Table 3, the pour point for the various base oils does not vary in the expected manner with respect to the viscosity of the base oils. Other than the 2 cSt base oil which has a pour point of −39° C., the remaining base oils have a relatively flat pour point profile. In fact, the 8 cSt base oil has a lower pour point than either the 4 cSt or 6 cSt base oil. Other than the 2 cSt base oil, the viscosity index profile of the base oils is also relatively flat, with the 4 cSt and higher viscosity base oils all having a VI of at least 130.

The overall yield of lubricant base oil is greater than 75 wt % relative to the effluent from the hydrotreating stage. It is noted that the unexpectedly flat pour point profile contributes to the high base oil yield. For a conventional feed, higher viscosity base oils can have a correspondingly higher pour point. In order to generate a slate of base oils that meet a desired pour point, increased reaction severity is required so that the higher viscosity fractions can also meet the desired pour point. This increased reaction severity typically corresponds to higher levels of feed conversion to lower boiling products, which results in increased yield of naphtha and/or diesel and reduced lubricant base oil yield. By contrast, due to the relatively low pour point for all fractions derived from the hydroprocessed petrolatum, and the relatively flat pour point profile, the reaction severity can be maintained at a less severe level. This results in reduced production of fuels fractions and greater production of lubricant base oils.

TABLE 3

Base Oil Fractions Derived from Hydroprocessed Petrolatum

| KV100 (cSt) | Pour Point (° C.) | VI | Overall Yield (wt % based on HDT feed) |
|---|---|---|---|
| 2.25 | −39 | 122 | 3.2 |
| 4.36 | −23 | 133 | 13.4 |
| 6.70 | −28 | 134 | 7.0 |
| 8.53 | −29 | 134 | 11.0 |
| 18.66 | −27 | 130 | 41.5 |
| Total | | | 76.1 |

Example 2—Yield of Lubricant Base Oil from Slack Wax Hydroprocessing (Comparative)

Another example of a feedstock with a high wax content is a slack wax feed. Slack waxes are formed during solvent dewaxing of a distillate fraction generated from a vacuum distillation unit, as opposed to petrolatum which is formed during solvent dewaxing of deasphalted bottoms. This means that slack waxes are formed from a lower boiling range portion of a feed. Although slack waxes can have wax contents of greater than 80 wt % or even greater than 90 wt %, the severity of processing required to convert a slack wax into a desirable lubricant basestock causes the yield of lubricant to be 60 wt % or less of hydrotreated slack wax feed.

Table 4 shows the results of hydroprocessing a 150N slack wax and a 600N for base oil production. The wax content of the 150N slack wax was 93%, while the wax content of the 600N slack wax was 87%. The hydroprocessed 150N slack wax is suitable for generating a 4 cSt base oil, while the 600N slack wax is suitable for generating a 6 cSt base oil. The reaction conditions for hydroprocessing the 150N slack wax and the 600N slack wax were selected to achieve at least a −20° C. pour point and to approximately achieve the target 4 cSt and 6.7 cSt viscosities, respectively. The slack waxes were processed at temperatures similar to the temperatures shown in Table 2 for processing of the petrolatum. The hydrogen partial pressure was 1000 psig (6.9 MPag). The treat gas rate and space velocities were also similar, with the exception that the treat gas rate for hydrotreatment of the slack waxes was lower, as a lower amount of conversion (1%-4%) was needed for the slack wax feeds in order to meet the desired viscosity targets.

As shown in Table 4, the base oil yield from processing of the slack waxes is substantially lower than the total base oil yield for hydroprocessed petrolatum shown in Table 3 at comparable (or higher) pour point. The results in Table 4 demonstrate that the unexpected properties of the lubricant base oils generated from hydroprocessed petrolatum are not simply a function of hydroprocessing a feed with a high wax content. The slack waxes used as feeds for the results in Table 4 have higher wax contents than the petrolatum in Example 1, but result in lower yields of base oils at comparable pour point.

TABLE 4

Base Oils from Hydroprocessed Slack Wax

| Feed | 150 N SW | 600 N SW |
|---|---|---|
| KV100 | 3.8-3.9 | 6.7-6.8 |
| Pour Point, ° C. | −24 | −21 |
| Lube Yield based on HDT Feed, wt % | 35 | 60 |

Example 3—Impact of Hydrotreating Severity on Lubricant Base Oil Yield

FIG. 2 shows a comparison of processing petrolatum under two different conditions. For the hydroprocessing results shown in FIG. 2, the dewaxing conditions are milder in order to generate a higher overall yield. The milder dewaxing conditions are also beneficial for investigating the impact of modifying the severity of the hydrotreatment process that is performed prior to dewaxing.

In FIG. 2, case 1 corresponds to hydroprocessing of petrolatum under hydrotreatment conditions that resulted in conversion of 3 wt % of the petrolatum feed relative to a 370° C. conversion temperature. The dewaxing conditions were then selected to cause 20 wt % conversion of the hydrotreated petrolatum. In case 2, the severity of the hydrotreatment conditions was increased in order to cause 7 wt % conversion of the petrolatum during hydrotreatment. The dewaxing conditions were comparable to case 1, but resulted in a slightly greater amount of conversion (22 wt %) of the hydrotreated effluent.

As shown in FIG. 2, increasing the severity of the initial hydrotreatment of the petrolatum can be used to shift the relative amounts of base oils produced during hydroprocessing. Increasing the severity of the hydrotreatment from 3 wt % to 7 wt % conversion resulted in an increase in the amount of 2 cSt and 4 cSt base oils generated, but at the expense of the total base oil yield due to more significant reduction in the amount of 16+ cSt base oil.

Additional Embodiments

Embodiment 1

A method for forming lubricant base oils, comprising: separating a feedstock into at least a first fraction and a bottoms fraction, a distillation cut point for separating the first fraction and the bottoms fraction being at least 950° F. (510° C.); deasphalting the bottoms fraction to form a deasphalted bottoms fraction and an asphalt product; extracting the deasphalted bottoms in the presence of an extraction solvent to form a raffinate stream and an extract stream, an aromatics content of the raffinate stream being lower than an aromatics content of the deasphalted bottoms; dewaxing the raffinate stream in the presence of a dewaxing solvent to form a lubricant base oil product and a waxy product having a wax content of at least 70 wt %; hydrotreating at least a portion of the waxy product under effective hydrotreating conditions to form a hydrotreated effluent, the effective hydrotreating conditions being effective for conversion of 10 wt % or less of a portion of the waxy product boiling above 700° F. (371° C.) to a portion boiling below 700° F. (371° C.); separating the hydrotreated effluent to form at least a liquid hydrotreated effluent; dewaxing the liquid hydrotreated effluent in the presence of a dewaxing catalyst under effective dewaxing conditions to form a dewaxed effluent, the effective dewaxing conditions being effective for conversion of 10 wt % to 35 wt % of a portion of the hydrotreated effluent boiling above 700° F. (371° C.) to a portion boiling below 700° F. (371° C.); and fractionating the dewaxed effluent to form a plurality of lubricant base oil products having a viscosity index of at least 120 and a pour point of −12° C. or less, the plurality of base oil products comprising at least a first base oil product having a lower pour point that a second base oil product, the first base oil product having a higher viscosity at 100° C. than the second base oil product.

Embodiment 2

A method for forming lubricant base oils, comprising: providing a waxy feedstock having a T5 boiling point of at least at least 800° F. (427° C.), a T50 boiling point of at least 1000° F. (538° C.), and a wax content of at least 70 wt %; hydrotreating the waxy feedstock under effective hydrotreating conditions to form a hydrotreated effluent, the effective hydrotreating conditions being effective for conversion of 8 wt % or less of a portion of the waxy product boiling above 700° F. (371° C.) to a portion boiling below 700° F. (371° C.); separating the hydrotreated effluent to form at least a liquid hydrotreated effluent; dewaxing the liquid hydrotreated effluent in the presence of a dewaxing catalyst under effective dewaxing conditions to form a dewaxed effluent, the effective dewaxing conditions being effective for conversion of 10 wt % to 35 wt % of a portion of the hydrotreated effluent boiling above 700° F. (371° C.) to a portion boiling below 700° F. (371° C.); and fractionating the dewaxed effluent to form a plurality of lubricant base oil products having a viscosity index of at least 120 and a pour point of −15° C. or less, the plurality of base oil products comprising at least a first base oil product having a lower pour point that a second base oil product, the first base oil product having a higher viscosity at 100° C. than the second base oil product, the first base oil product and the second base oil product having a viscosity index of at least 130.

Embodiment 3

The method of any of the above embodiments, wherein the first base oil product and the second base oil product have a viscosity index of at least 130, such as at least 140.

Embodiment 4

The method of any of the above embodiments, wherein the plurality of lubricant base oil products have a pour point of −15° C. or less, such as −18° C. or less.

Embodiment 5

The method of any of the above embodiments, wherein the waxy feedstock or the waxy product has a T5 boiling point of at least 850° F. (454° C.).

Embodiment 6

The method of any of the above embodiments, wherein the waxy feedstock or the waxy product has a T50 boiling point of at least 1050° F. (566° C.).

Embodiment 7

The method of any of the above embodiments, wherein the waxy product or the waxy feedstock has a wax content of at least 75 wt %.

Embodiment 8

The method of any of the above embodiments, wherein the first base oil product has a viscosity of at least 7.5 cSt at 100° C., such as at least 8.0 cSt.

Embodiment 9

The method of any of the above embodiments, wherein the second base oil product has a viscosity of at least 3.5 cSt at 100° C., such as at least 4.0 cSt.

Embodiment 10

The method of any of the above embodiments, wherein a total yield for the plurality of base oils is at least 70 wt % of the liquid hydrotreated effluent, such as at least 75 wt %.

Embodiment 11

The method of any of the above embodiments, wherein the first base oil has a viscosity of at least 12 cSt at 100° C., such as at least 16 cSt.

Embodiment 12

The method of any of the above embodiments, wherein the plurality of base oils further comprises a third base oil having a viscosity of at least 12 cSt at 100° C., such as at least 16 cSt, the third base oil having a viscosity index of at least 130.

Embodiment 13

The method of any of the above embodiments, wherein the plurality of base oils are substantially free of haze.

Embodiment 14

The method of any of the above embodiments, wherein the amount of conversion during hydrotreating is 8 wt % or less relative to a conversion temperature of 371° C., such as 5 wt % or less.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A hydroprocessed effluent comprising a plurality of lubricant base stocks, the plurality of lubricant base stocks comprising:

a first lubricant base stock in the hydroprocessed effluent having a kinematic viscosity at 100° C. of at least 8.0 cSt; and a second lubricant base stock in the hydroprocessed effluent having a kinematic viscosity at 100° C. of at least 3.5 cSt and less than the first lubricant base stock, the first lubricant base stock having a pour point equal to or less than a pour point of the second lubricant base stock, wherein the hydroprocessed effluent is formed by hydroprocessing at least a portion of a bottoms fraction of a feedstock to form a plurality of lubricant base oil products having a viscosity index of at least 120 and a pour point of −12° C. or less, the plurality of base oil products comprising at least the first base oil product and the second base oil product.

2. The hydroprocessed effluent of claim 1, wherein the second lubricant base stock has a kinematic viscosity at 100° C. of at least 4.0 cSt.

3. The hydroprocessed effluent of claim 1, wherein the first lubricant base stock has a kinematic viscosity at 100° C. of at least 7.5 cSt.

4. The hydroprocessed effluent of claim 1, wherein the hydroprocessed effluent comprises at least 7 wt % of the second lubricant base stock.

5. The hydroprocessed effluent of claim 1, wherein the hydroprocessed effluent comprises at least 11 wt % of the first lubricant base stock.

6. The hydroprocessed effluent of claim 1, wherein the hydroprocessed effluent comprises a plurality of second lubricant base stocks.

7. The hydroprocessed effluent of claim 1, wherein the first lubricant base stock and the second lubricant base stock having a viscosity index of at least 120.

8. The hydroprocessed effluent of claim 1, wherein the first lubricant base stock and the second lubricant base stock having a viscosity index of at least 130.

9. The hydroprocessed effluent of claim 1, wherein the second lubricant base stock has a pour point of −15° C. or less.

10. The hydroprocessed effluent of claim 1, wherein the second lubricant base stock has a pour point of −18° C. or less.

11. The hydroprocessed effluent of claim 1, wherein the hydroprocessed effluent further comprises one or more additional lubricant base stocks having a kinematic viscosity at 100° C. of at least 2 cSt.

12. The hydroprocessed effluent of claim 11, wherein the hydroprocessed effluent comprises at least 65 wt % of the first lubricant base stock, the second lubricant base stock, and the one or more additional lubricant base stocks.

13. The hydroprocessed effluent of claim 1, wherein the hydroprocessed effluent further comprises a third lubricant base stock having a kinematic viscosity at 100° C. of at least 12.0 cSt and a viscosity index of at least 130, the third lubricant base stock being different from the first lubricant base stock.

14. The hydroprocessed effluent of claim 13, wherein the third lubricant base stock has a kinematic viscosity at 100° C. of at least 16.0 cSt.

15. The hydroprocessed effluent of claim 13, wherein the third lubricant base stock has a pour point of −18° C. or less.

16. The hydroprocessed effluent of claim 13, wherein the hydroprocessed effluent further comprises one or more additional lubricant base stocks having a kinematic viscosity at 100° C. of at least 2 cSt.

17. The hydroprocessed effluent of claim 16, wherein the hydroprocessed effluent comprises at least 65 wt % of the first lubricant base stock, the second lubricant base stock, the third lubricant base stock, and the one or more additional lubricant base stocks.

18. The hydroprocessed effluent of claim 1, wherein the pour point of the first lubricant base stock is less than the pour point of the second lubricant base stock.

19. The first lubricant base stock and the second lubricant base stock of claim 1, wherein the first lubricant base stock and the second lubricant base stock are separated from the hydroprocessed effluent by fractionation.

* * * * *